US007610656B2

(12) United States Patent
Vanini

(10) Patent No.: US 7,610,656 B2
(45) Date of Patent: Nov. 3, 2009

(54) HINGE FOR WINGS OR DOORS

(75) Inventor: Angelo Vanini, Bologna (IT)

(73) Assignee: Nuova Star S.p.A., Zola Predosa (Bologna) (IT)

( * ) Notice: Subject to any disclaimer, the term of this patent is extended or adjusted under 35 U.S.C. 154(b) by 0 days.

(21) Appl. No.: 12/071,334

(22) Filed: Feb. 20, 2008

(65) Prior Publication Data

US 2008/0201907 A1 Aug. 28, 2008

(30) Foreign Application Priority Data

Feb. 22, 2007 (IT) ..... BO2007A0110

(51) Int. Cl.
*E05F 1/08* (2006.01)

(52) U.S. Cl. ..... 16/286

(58) Field of Classification Search ..... 16/286, 16/290, 297; 49/386, 387; 126/194
See application file for complete search history.

(56) References Cited

U.S. PATENT DOCUMENTS 4,545,322 A * 10/1985 Yang ..... 188/67
4,658,473 A * 4/1987 Schema ..... 16/290
5,787,549 A * 8/1998 Soderlund ..... 16/308
7,317,611 B2 * 1/2008 Dittmer ..... 361/681
2003/0213098 A1 * 11/2003 Cummins et al. ..... 16/286
2006/0032019 A1 * 2/2006 Kistner et al. ..... 16/286

FOREIGN PATENT DOCUMENTS

IT BO 2006 A000308 4/2006

* cited by examiner

*Primary Examiner*—Victor Batson
*Assistant Examiner*—Matthew Sullivan
(74) *Attorney, Agent, or Firm*—The Nath Law Group; Jerald L. Meyer; Jiaxiao Zhang

(57) ABSTRACT

A hinge for wings or doors, in particular of electrical appliances, comprises a first element, a second element and a lever for connecting the first and second elements; the lever pivots on the second element and has a first arm integral with the first element to render the first and second elements movable relative to one another with a tilting action between a closed position and an open position; the second element consisting of a substantially box-shaped body containing a spring, inserted between the second element and a second arm of the lever so as to apply an elastic action to the lever.

22 Claims, 4 Drawing Sheets

6
6a
6b
12
13
14
25
26
27
22
19
11
P
10
A
4
7
7a

HINGE FOR WINGS OR DOORS

BACKGROUND OF THE INVENTION

The present invention relates to a hinge for wings or doors.

In particular, the present invention relates to a hinge which can be used for constraining the doors of electrical appliances, such as ovens, to the respective supporting structures.

In the following description and by way of example only, without limiting the scope of the invention, the present invention is described with reference to an oven.

Hinges of this type normally consist of two separate parts, kinematically connected to one another, directly or by inserting a lever between them.

More precisely, the first of said parts is fixed to the oven structure at one side of the oven mouth, whilst the second part is fixed to one edge of the door, which in that way is rendered movable, with a tilting action, relative to the above-mentioned oven mouth.

One or more elastic elements are inserted between the two parts of the hinge.

During door rotation starting from its closed position, the elastic elements oppose, during a first step, the detachment of the door from the oven supporting frame and, in a second step, they oppose the subsequent rotation of the door and its consequent lowering to an end of stroke position in which the oven mouth is completely open.

In this second opening step, the door, under the combined action of its own weight which promotes its descent and of the elastic elements which apply a braking action, performs a gradual rotation.

During door rotation starting from its open end of stroke position, the action of the elastic elements is first balanced by the weight of the door, initially guaranteeing gradual closing rotation; however, then, in the absence of a braking action by the user, the elastic elements push the door towards the oven frame with sufficient force to guarantee its effective closing.

Basically, the presence of the hinges with elastic elements balances the door, so that when it is opened it does not drop open, and when it is closed it does not forcefully spring back to its closed position.

In its opening and closing movements, irrespective of the action of the user, the door is subject to the action of two different torques, an "opening" torque to which the weight of the door contributes, and a "closing" torque, basically determined by the elastic reaction force of the hinge springs.

At least beyond a predetermined door opening angle, for example greater than 30°, the opening torque will advantageously be positive, whilst the closing torque will have a negative value.

Said values are the preferred values for good operation of the door. If the spring or springs contained in the hinge were too weak, the opening torque could become negative, requiring that the operator apply a braking action to door opening, otherwise the door would just drop open. In contrast, if the spring or springs were to generate an elastic reaction force that was too great, the closing torque could become positive, therefore resulting in violent door closing.

As already indicated, correct door operation basically requires that, at least beyond a predetermined opening angle, the opening torque is positive and the closing torque is negative.

The difference in the absolute value between the two torques in practice indicates the versatility of the hinge, that is to say, the range of different door weights that a predetermined hinge can balance.

Prior art hinges have the disadvantage of being suitable for balancing doors within a rather limited weight range, therefore obliging manufacturers and users to adopt extensive ranges of hinges in order to be able to vary the weights of the doors.

For example, the same electrical appliance, finished with covering surfaces which have different weights, must be fitted with different hinges. This means that in the worst case the hinges and door must be mounted only after the covering has been selected.

SUMMARY OF THE INVENTION

The aim of the present invention is therefore to increase the balancing capacity of a hinge, so that it can be used with a large number of doors having different weights, without modification of the elastic elements and/or changes to the adjustment or calibration being needed for each door.

Accordingly, the present invention provides a hinge for wings or doors comprising the features described in any of the claims herein.

The technical features of the present invention, in accordance with the above aim, are clear from the content of the claims herein, in particular claim 1 and, preferably, from any of the claims directly or indirectly dependent on claim 1.

BRIEF DESCRIPTION OF THE DRAWINGS

The advantages of the present invention are more apparent in the detailed description which follows, with reference to the accompanying drawings which illustrate a preferred, non-limiting embodiment of the invention, in which.

DESCRIPTION OF THE PREFERRED EMBODIMENTS

Figure 1:
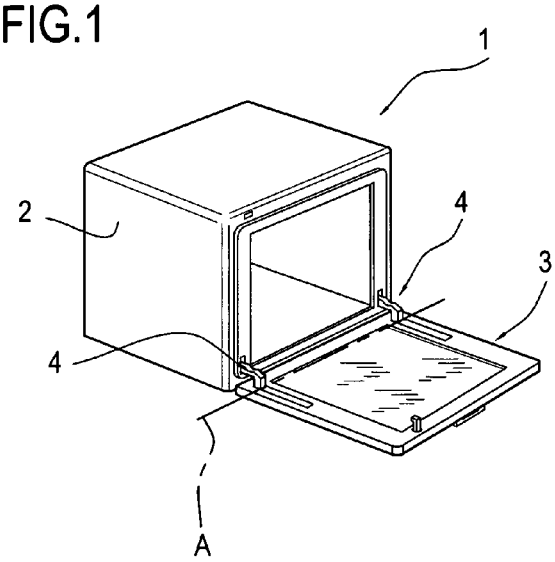
FIG. 1 is a schematic perspective top view of an oven fitted with a door which is constrained to it by two hinges made in accordance with the present invention.

With reference to FIG. 1, the numeral 1 denotes as a whole an oven comprising a frame 2 to which a door 3 is connected by two hinges 4, which allow the door to rotate with a tilting action about a first horizontal axis A.

Figure 2:
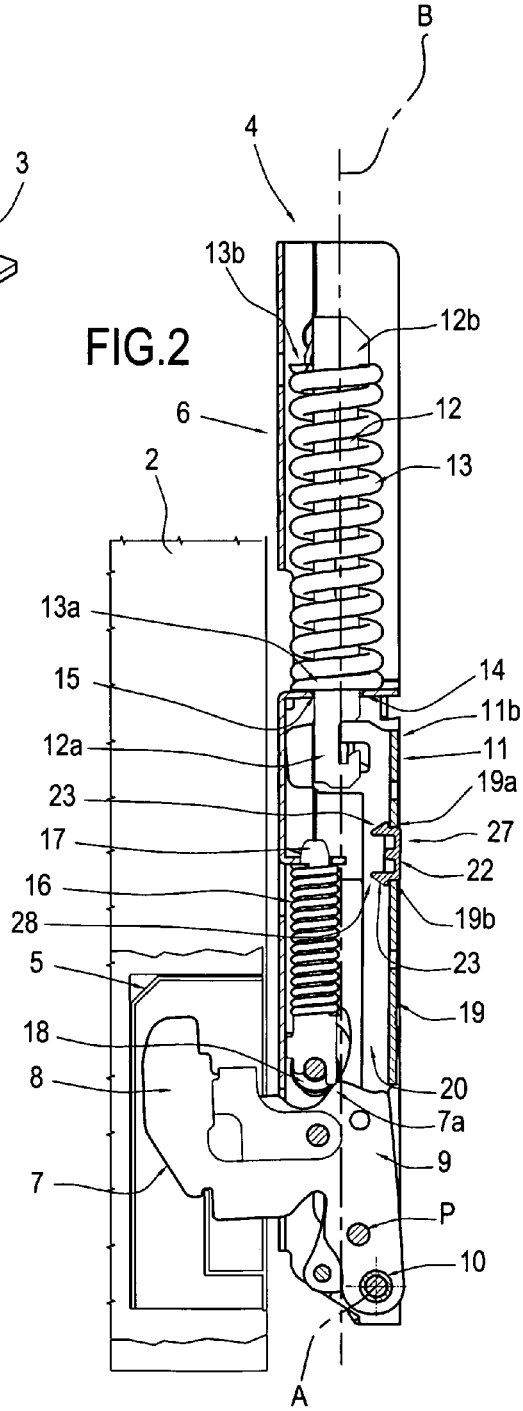
FIG. 2 is a schematic side elevation view, with some parts in cross-section or transparent to better illustrate others, of a hinge in accordance with the present invention.

With reference to FIG. 2, each of the two hinges 4 comprises a first box-shaped element 5 fixed to the oven 1 frame 2, and a second element 6, also box-shaped, fixed to the door 3. The first and second box-shaped elements 5, 6 are kinematically connected to one another by a connecting lever 7.

Figure 3:
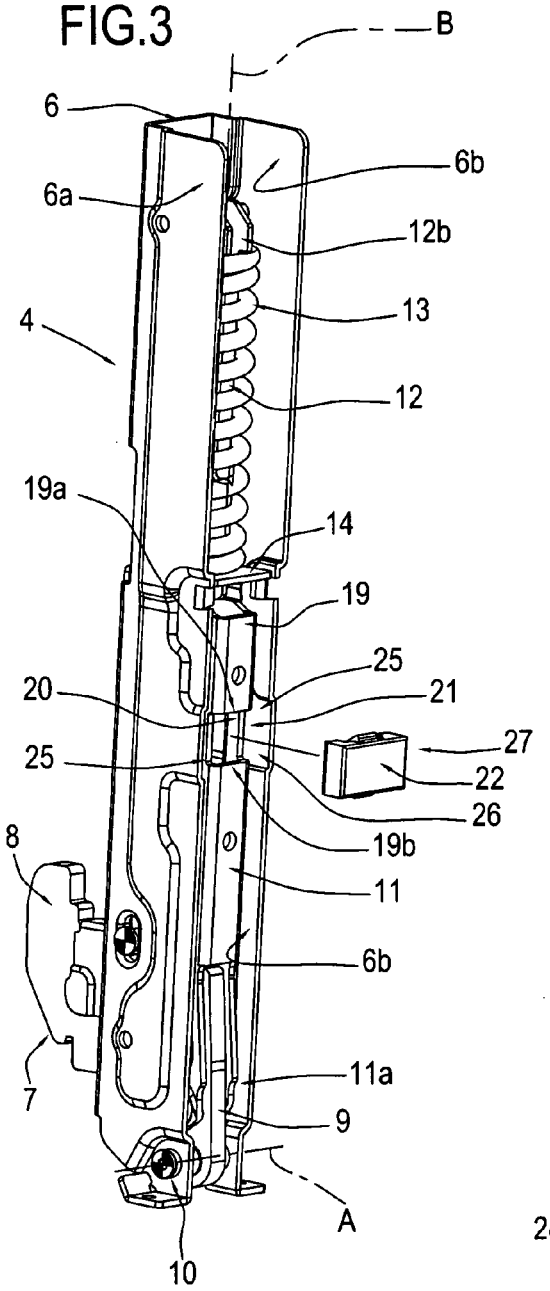
FIG. 3 is a perspective view, with an exploded detail, of the hinge of FIG. 2.

As illustrated in FIG. 3, the second box-shaped element 6 has a substantially C-shaped cross-section and extends longitudinally along its own axis B, hereinafter also indicated as the main direction of extension of the second element 6.

The connecting lever 7 comprises a first arm 8, designed to be rigidly constrained to the first box-shaped element 5, and a second arm 9 connected to the second box-shaped element 6.

For the connection between the second arm 9 and the second box-shaped element 6, the hinge 1 comprises a first pin 10 passing through a respective hole made at the end of the second arm 9 and coaxial with the axis A.

As illustrated in FIGS. 2 and 3, the hinge 4 also comprises a rod 11 and a shaft 12 positioned one after another longitudinally according to the axis B, in the second box-shaped element 6 and hooked to each other.

The rod 11 is box-shaped and has a C-shaped cross-section, with a lower end 11*a* pivoting on the lever 7, at a pin P, in the substantially known way, and an upper end 11*b* which connects to a lower end 12*a* of the shaft 12.

The second box-shaped element 6 houses a first helical spring 13, fitted on the outside of the shaft 12 and stressed in compression, as described in more detail below.

With reference to FIG. 2, the second box-shaped element 6 is divided into two portions, an upper portion housing the first spring 13 and a lower portion housing the rod 11. The two portions, upper and lower, are separated by a separator 14 in which there is a hole 15 for the passage of the shaft 12.

The separator 14 also forms a contact surface for a proximal end coil 13*a* of the spring 13.

The shaft 12 has an upper end 12*b* longitudinally opposite the end 12*a* hooked to the rod 12. The upper end 12*b* is designed to engage with a distal end coil 13*b* to compress the spring 14.

For the hinge 4, the spring 13 constitutes an elastic element designed to generate a reaction force which opposes door 3 opening.

Only when the closed position is almost reached, from and towards the closed position, overlapping with the above-mentioned elastic action of the spring 13 there is the action of a second pre-compressed helical spring 16, designed to operate in conjunction with a cam 7*a* made on the rocker lever 7, through a stem 17 acting on a cam follower 18, to give the door 3 a spring-to closing movement and to define a door stable semi-open position.

The structural and functional features of the second spring 23 have already been described in Italian patent application BO2006A000308 by the same Applicant, to which reference is made, and therefore, said features are not examined in depth in this description.

With reference to FIG. 3, the C-shaped box-shaped rod 11 comprises a front wall 19 and two lateral walls 20 which are parallel with one another, only one of which is visible in the drawing. In the front wall 19 of the rod 11 there is an opening 21. A friction element 22, advantageously made of a plastic material, engages in the opening 21.

Figure 4:
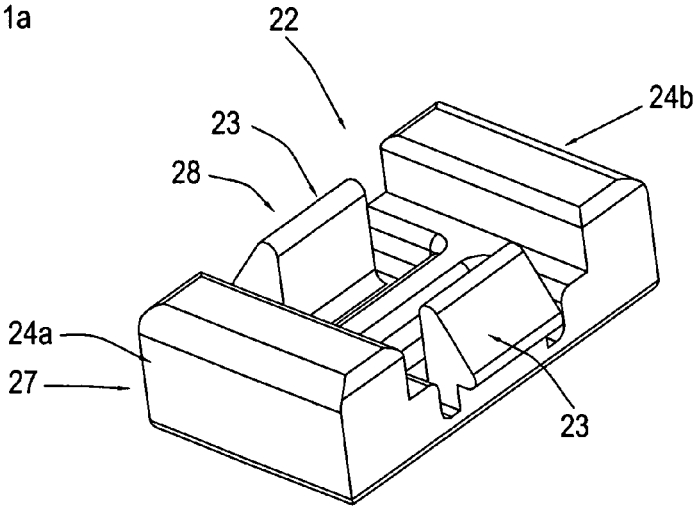
FIG. 4 is a perspective view of the exploded detail from FIG. 3.

With reference to FIG. 4, the friction element 22 comprises two teeth 23 and, on opposite sides of them, two respective lateral projections 24*a*, 24*b*.

The two teeth 23 are designed to hook with a snap-on action on respective contact portions 19*a*, 19*b* formed by the same number of edges of the front wall 19 forming the opening 21.

The lateral projections 24*a*, 24*b* of the friction element 22 are each positioned opposite a respective longitudinal lateral wall 6*a*, 6*b* of the second box-shaped element 6 and, as is more clearly explained below, are designed to engage with the longitudinal walls 6*a*, 6*b* by rubbing.

Figure 8:
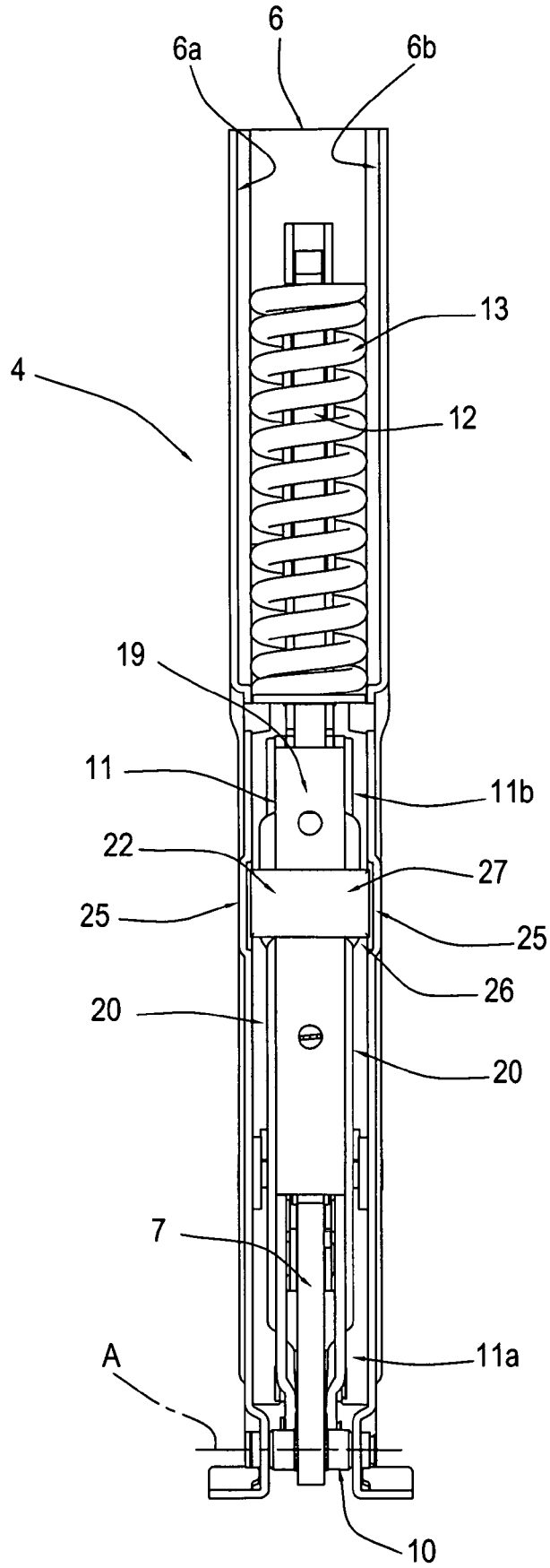
FIG. 8 is a schematic side elevation view of the hinge of FIG. 2.

With reference to FIG. 8, along the longitudinal walls 6*a*, 6*b* of the second box-shaped element 6 there are respective recesses 25, opposite one another, the recesses 25 forming a zone 26 for housing the friction element 22. In said zone the friction element 22 does not apply any friction on the walls 6*a*, 6*b*.

In the interaction of its projections 24*a*, 24*b* with the longitudinal walls 6*a*, 6*b*, the friction element 22 forms respective friction means 27 for the hinge 4.

The teeth 23 of the friction element 22 form removable means 28 for connecting the element 22 to the rod 11.

The following is a brief description of the operation of one of the two hinges 4 starting from the door 3 closed position, schematically illustrated in FIGS. 2 and 3.

The torque applied to the door 3 when it is opened, by the user and, beyond a predetermined rotation, by the weight of the door 3, conflicts with the torque generated by the spring 13, which therefore renders the movement of the door 3 towards the fully open position illustrated in FIG. 1 gradual and subject to a braking action.

Starting from the door 3 fully open position illustrated in FIG. 1, a rotation of the door towards the closed position is promoted by the action of the spring 13 and is initially hindered by the weight of the door 3.

Figures 5, 6, 7:
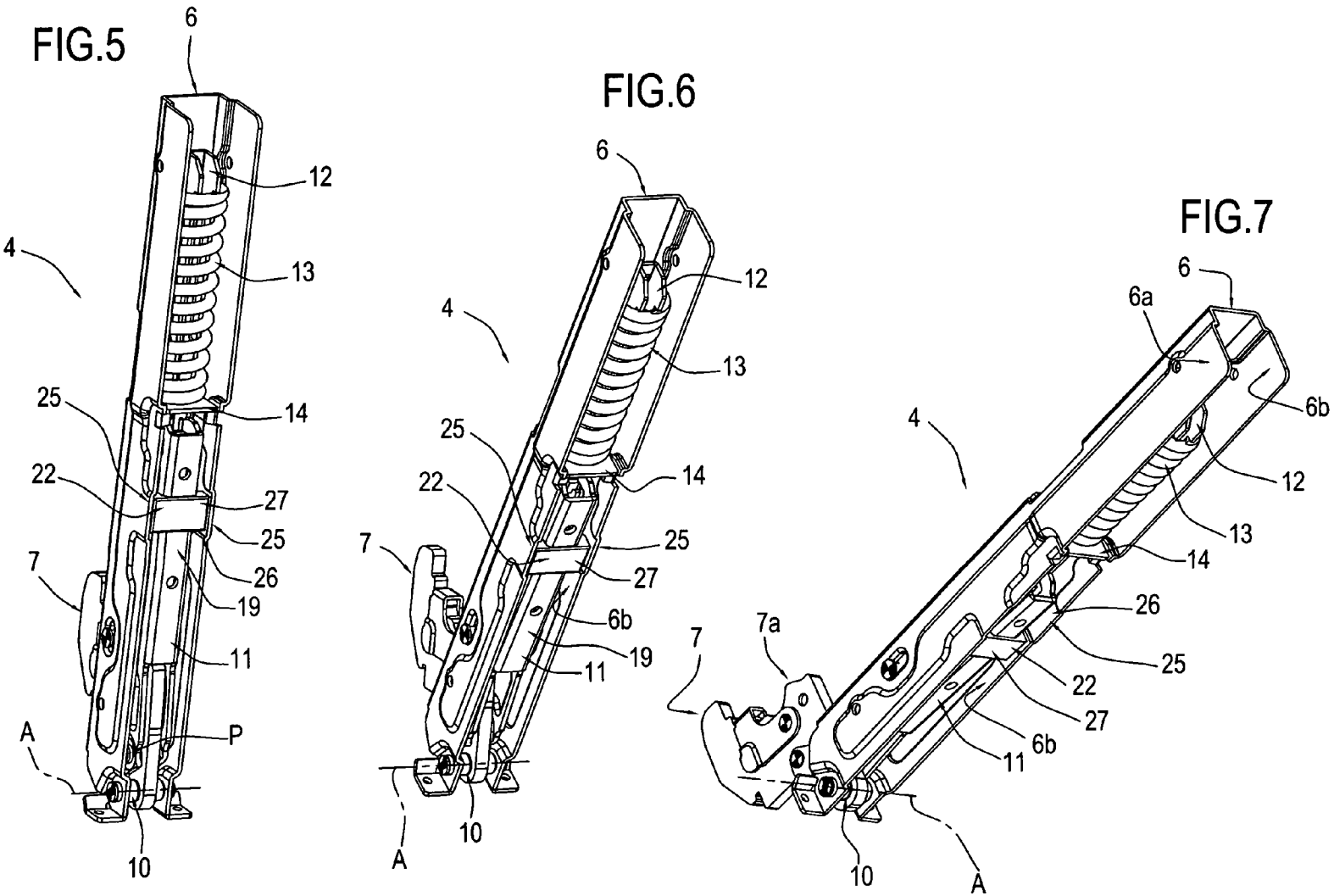
FIGS. 5, 6 and 7 are respective schematic perspective views of the hinge of the previous figures in three different operating configurations.

In detail, FIGS. 5 to 7 illustrate in sequence different hinge 4 opening configurations. FIG. 5 shows a closed configuration, FIG. 6 a mid-open configuration and FIG. 7 a substantially open configuration.

In passing from the closed configuration of FIG. 5 to the open configuration of FIG. 7, the spring 13 is compressed and loaded by the action applied by the shaft 12 which is in turn pulled by the rod 11. The rod 11 is pulled by the rotation of the lever 7 relative to the second box-shaped element 6 about the axis A. Therefore, as it pulls the shaft 12, the rod 11 slides inside the box-shaped element 6 relative to it.

In the configuration illustrated in FIG. 5, the friction element 22 is positioned in the housing 26 formed by the recesses 25 and, therefore, with its lateral projections 24*a*, 24*b* detached from the longitudinal walls 6*a*, 6*b* of the box-shaped element 6. In said configuration, since the projections 24*a*, 24*b* are not in contact with the walls 6*a*, 6*b*, no friction is applied between the friction element 22 and the second box-shaped element 6.

When the wing or door 3 is opened by the user, that is to say, passing to the configuration illustrated in FIG. 6, in which the rod 11 slides towards the axis A, the projections 24*a*, 24*b* exiting the housing zone 26, begin to engage with the lateral walls of the second box-shaped element 6 by sliding. Said sliding creates friction between the friction element 22 which hinders door 3 opening, also contributing to making the movement fluid and damped and reducing the possibility of sudden, sharp movements by the door.

The sliding of the projections 24*a*, 24*b* continues until the hinge 4 fully open configuration is reached, as illustrated in FIG. 7 and, logically, also in the opposite path which returns the hinge 4 to its closed configuration illustrated in FIGS. 2 and 3.

In other words, the friction or rubbing created between the friction element 22 and the walls 6*a*, 6*b* of the second element 6 during their relative movement, causes a dissipation of energy, by friction.

It was realized that said dissipation, obtained by increasing hinge internal frictions, advantageously allows extension of the door weight range that a predetermined hinge can balance. Experimentally, it was found that a hinge of the type described, when it has no friction element 22, can balance doors of different weights within a range of approximately 350 g whilst, if the friction element 22 is used, the same hinge can effectively balance doors of different weight within a range of approximately 1000 g.

In other words, if the hinge without friction means 27, consisting for example of the friction element 22, can balance different doors 3 whose weights differ by a maximum of 350 g, the same hinge when fitted with the friction element 22 can effectively balance different doors 3 whose weights differ by up to 1000 g.

Therefore, the friction means 27 increase hinge 3 internal frictions by a value which does not make it difficult to move the door and so they make it possible to adapt the hinge 3 to a vast range of doors, even with weights that are very different to one another.

In other words, use of the friction means 27 allows an increase in the absolute value of the difference between the torques for "opening" and "closing" the door 3, a value which, as already indicated, in practice defines the versatility of the hinge, that is to say, the range of different door weights that a predetermined hinge can balance.

Advantageously, the positioning of the friction element 22 in the housing 26, with its lateral projections 24*a*, 24*b* detached from the longitudinal walls 6*a* and 6*b*, means that nothing hinders door 3 closing. Therefore, when the door 3 is closed, the elastic energy of the second spring 16 is not dissipated by the friction means 27 and so can fully contribute to hermetic closing of the door 3.

According to an alternative embodiment of the hinge disclosed, not illustrated, the opposite longitudinal walls 6*a*, 6*b* of the second element 6 are made in such a way that they converge towards the pin 10, at least over one stretch of their longitudinal extension. In that way, advantageously there is an increase in the friction force developed between the walls 6*a*, 6*b* and the friction element 22 when passing from the door 3 closed position to the open position.

The invention described above is susceptible of industrial application and may be modified and adapted in several ways without thereby departing from the scope of the inventive concept. Moreover, all details of the invention may be substituted by technically equivalent elements.

What is claimed is:

1. A hinge for wings or doors, in particular of electrical appliances, comprising:

a first element;

a second element;

a lever for connecting the first element and the second element, the lever pivoting on the second element by means of a pin rendering the first element and the second element movable relative to one another with a tilting action, wherein the first element and the second element may be affixed, one to a frame and the other to a wing or door, so that the wing or door can move relative to the frame between a closed position and an open position;

the second element being a second box-shaped element and containing elastic means connected to the lever by a rod which slides inside the second box-shaped element; and wherein the hinge further comprises friction means for applying a braking action to the reciprocal sliding of the rod relative to the second box-shaped element, the friction means comprising a friction element which comprises two teeth designed to engage with a snap-on action with a respective contact portion.

2. The hinge according to claim 1, wherein the friction element is inserted between the rod and the second box-shaped element and integral with one of the rod and the second box-shaped element.

3. The hinge according to claim 2, wherein the friction element is connected to the rod.

4. The hinge according to claim 3, wherein the friction element comprises removable connecting means for connecting the friction element to the rod.

5. The hinge according to claim 4, wherein at least one tooth, designed to engage with a snap-on action with a respective contact portion of the rod, forms the removable connecting means.

6. The hinge according to claim 3, where the second box-shaped element comprises two walls extending longitudinally opposite one another, wherein the friction element comprises two opposite lateral projections, each designed to engage with one of the walls of the second box-shaped element by rubbing.

7. The hinge according to claim 6, wherein the opposite longitudinal walls of the second box-shaped element comprise respective recesses forming a zone for housing the friction element, the friction element not applying any friction on the longitudinal walls in said zone.

8. The hinge according to claim 7, wherein the friction element is positioned in the housing zone at least when the wing or door is in the closed position.

9. The hinge according to claim 6, wherein the opposite longitudinal walls converge with one another to increase the friction force developed between the walls and the friction element as the wing or door passes from the closed position to the open position.

10. The hinge according to claim 2, wherein the friction element is made of a plastic material.

11. An electrical appliance, comprising a frame, a door and at least one hinge according to claim 1, for connecting the door to the frame.

12. The hinge according to claim 4, wherein the second box-shaped element comprises two walls extending longitudinally opposite one another, wherein the friction element comprises two opposite lateral projections, each designed to engage with one of the walls of the second box-shaped element by rubbing.

13. The hinge according to claim 5, wherein the second box-shaped element comprises two walls extending longitudinally opposite one another, wherein the friction element comprises two opposite lateral projections, each designed to engage with one of the walls of the second box-shaped element by rubbing.

14. The hinge according to claim 7, wherein the opposite longitudinal walls converge with one another to increase the friction force developed between the walls and the friction element as the wing or door passes from the closed position to the open position.

15. The hinge according to claim 8, wherein the opposite longitudinal walls converge with one another to increase the friction force developed between the walls and the friction element as the wing or door passes from the closed position to the open position.

16. The hinge according to claim 7, wherein the friction element is made of a plastic material.

17. The hinge according to claim 8, wherein the friction element is made of a plastic material.

18. The hinge according to claim 9, wherein the friction element is made of a plastic material.

19. An electrical appliance, comprising a frame, a door and at least one hinge according to claim 9, for connecting the door to the frame.

20. An electrical appliance, comprising a frame, a door and at least one hinge according to claim 10, for connecting the door to the frame.

21. A hinge for wings or doors, in particular of electrical appliances, comprising:

a first element;

a second element;

a lever for connecting the first element and the second element, the lever pivoting on the second element by means of a pin rendering the first element and the second element movable relative to one another with a tilting action, wherein the first element and the second element may be affixed, one to a frame and the other to a wing or door, so that the wing or door can move relative to the frame between a closed position and an open position;

the second element being box-shaped and containing elastic means connected to the lever by a rod which slides inside the second box-shaped element; and the hinge further comprising friction means for applying a braking action to the reciprocal sliding of the rod relative to the second box-shaped element, the friction means comprising a friction element inserted between the rod and the second box-shaped element, wherein the friction element comprises removable connecting means for connecting the friction element to the rod, wherein the connecting means comprise at least one tooth designed to engage with a snap-on action with a respective contact portion of the rod.

22. A hinge for wings or doors, in particular of electrical appliances, comprising:

a first element;

a second element;

a lever for connecting the first element and the second element, the lever pivoting on the second element by means of a pin rendering the first element and the second element movable relative to one another with a tilting action, wherein the first element and the second element may be affixed, one to a frame and the other to a wing or door, so that the wing or door can move relative to the frame between a closed position and an open position;

the second element being a second box-shaped element and containing elastic means connected to the lever by a rod which slides inside the second box-shaped element; and wherein the hinge further comprises friction means for applying a braking action to the reciprocal sliding of the rod relative to the second box-shaped element, the friction means comprising a friction element which comprises two teeth and, on opposite sides of them, two respective lateral projections.

* * * * *